US010002595B2

(12) United States Patent
Feliciano

(10) Patent No.: US 10,002,595 B2
(45) Date of Patent: Jun. 19, 2018

(54) RHINO RESONATOR AND FLUTE CROWN

(71) Applicant: Roberto Feliciano, Bayamon, PR (US)

(72) Inventor: Roberto Feliciano, Bayamon, PR (US)

( * ) Notice: Subject to any disclaimer, the term of this patent is extended or adjusted under 35 U.S.C. 154(b) by 162 days.

(21) Appl. No.: 15/277,760

(22) Filed: Sep. 27, 2016

(65) Prior Publication Data

US 2017/0092240 A1 Mar. 30, 2017

Related U.S. Application Data

(60) Provisional application No. 62/234,074, filed on Sep. 29, 2015.

(51) Int. Cl.
*G10D 7/02* (2006.01)
*G10D 9/00* (2006.01)

(52) U.S. Cl.
CPC ..... *G10D 7/026* (2013.01); *G10D 9/00* (2013.01)

(58) Field of Classification Search
CPC ..... G10D 7/026; G10D 9/00
USPC ..... 84/384
See application file for complete search history.

(56) References Cited

U.S. PATENT DOCUMENTS 1,376,004 A * 4/1921 Christensen ..... G10D 7/026 84/384
4,240,320 A * 12/1980 Pellerite ..... G10D 7/026 84/384
8,669,449 B1 * 3/2014 Feliciano ..... G10D 9/00 84/384
2007/0272071 A1 * 11/2007 Parmenon ..... G10D 7/026 84/384

* cited by examiner

*Primary Examiner* — Jianchun Qin
(74) *Attorney, Agent, or Firm* — Luis Figarella

(57) ABSTRACT

A wind instrument cavity resonator and optional flexible flute crown assembly capable of improved sound generation and amplification within a flute or piccolo body is presented. The crown presents a swiveling nut joint, and the resonator has one or more counterweights to assist in the sound and weight balancing of the musical instrument, creating an acoustically pleasing flute or similar sound generation device.

16 Claims, 8 Drawing Sheets

1002

1004

802

RHINO RESONATOR AND FLUTE CROWN

CROSS-REFERENCE TO RELATED APPLICATIONS

This application claims priority to U.S. Provisional patent application Ser. No. 62/234,074 titled "Rhino Resonator and Flute Crown", filed on Sep. 29, 2015 the disclosure of which is herein incorporated by reference in its entirety.

PATENTS CITED

The following documents and references are incorporated by reference in their entirety, Feliciano (U.S. Pat. No. 8,669,449), Williams et al (U.S. Pat. No. 7,476,793), Seidman (U.S. Pub. No. 2010/0018380), Ferron (U.S. Pat. No. 4,499,810), Christensen (U.S. Pat. No. 1,376,004), Parmenon (U.S. Pub. No. 2007/0272071), Drelinger (U.S. Pat. No. D652,443) and Pellerite (U.S. Pat. No. 4,240,320).

FIELD OF THE INVENTION

The present invention relates generally to the field of musical instruments, particularly that of acoustically pleasing flute crown heads and sound cavity resonator for flutes or similar sound generation devices.

DESCRIPTION OF THE RELATED ART

Modern flutes, including concert flutes and piccolos, are often constructed of metal and include a body portion which is detachably connected to a head joint. The body portion includes the finger holes and keys and the head joint includes the embouchure hole and lip plate.

Like nearly all musical instruments, flutes (as well as piccolos) are made up of two basic elements: a generator, which gets the vibration going, and a resonator, which amplifies the vibration and modifies it to create the sound of the instrument. On the flute, the generator is the mouth hole edge against which the player's breath is directed.

When the breath meets the edge, it does not, as might be expected, divide into two separate air streams. Instead, the air stream rapidly fluctuates between going all into the hole and going all away from the hole. This sets up a rapid vibration at the head of the tube, with the rest of the tube being the container for the resonator. The mechanisms on the outside of the flute are for the sole purpose of opening and closing the holes. Acoustically speaking, this tube is considered to be open at both ends, since the mouth hole acts as if it were an open end.

The head of the tube has traditionally had in the free end of the head joint a stopper. The stopper is that obstruction in the bore of the flute, just beyond the embouchure hole. It often takes the form of a cork, with or without a screw connection to the cap or crown, also usually made of cork and anchored to a crown fitting by a threaded engagement.

This 'upstream air' acts like a spring—when you compress it, the pressure rises. With the cork correctly placed, it compensates for the frequency dependent end effects at the other end of the flute and so keeps the registers in tune with each other. However, cork has its disadvantages. For instance, a certain amount of dampening in the head joint is necessary, but the very nature of cork sometimes provides too great a degree of dampening. Such dampening adversely affects the sound quality of the instrument. Cork also deteriorates with exposure to moisture and actually decreases in size over time. Consequently, a flute cork stopper begins to develop air leaks which gradually become worse. In many cases, the flautist may be unaware of such leaks gradual leaks, or incapable of ascertaining the cause of the decrease in flute performance.

As the name implies, this "stopper" defines the cavity of the flute and it is usually set one bore diameter back from the middle of the embouchure. The Rhino Stopper (U.S. Pat. No. 8,669,449) has the market-proven advantage of using a flexible O-ring to perform the cavity defining function. However, what is needed besides the airtight stopper structure, is the ability to adjust the stopper's mass (making it a resonator) and enhance the coupling to the flute crown.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

In one aspect the invention is about a flute resonator comprising a mechanical plug having a distal end with a diameter that is slightly smaller than the head joint body interior diameter, said distal end having a U-channel groove for securing a single O-ring, so that only said single O-ring perimeter continuously contacts the flute interior surface, and a narrow diameter near end having flute crown screw securing means, said plug having an opening through said plug's center suitable for passage through said opening of said crown screw, an O-ring and one or more counterweights designed to fit around said mechanical plug near end.

In another aspect, it said flute crown screw securing means are comprised of a nut smaller than the diameter of the head joint that is used to lock the movement of said plug body to that of said flute crown screw, said counterweights are secured to said mechanical plug via one or more set screws and said flute crown is comprised of a crown assembly having a swiveling joint nut designed to fit around said crown screw.

In yet another aspect, said flute crown screw securing means are comprised of a flat nut smaller than the diameter of the head joint that is used to lock the movement of said plug body to that of said flute crown screw, said counterweights are secured to said mechanical plug via one or more set screws and said flute crown is comprised of a crown assembly having a swiveling joint nut designed to fit around said crown screw.

In another aspect, said flute crown screw securing means are comprised of an NPT fitting nut smaller than the diameter of the head joint that is used to lock the movement of said plug body to that of said flute crown screw, said counterweights are secured to said mechanical plug via one or more set screws and a crown assembly having a swiveling joint nut. In yet another aspect, said plug's near end inside is tapered, said flute crown screw securing means are comprised of a compression fitting having a compression ring smaller than the diameter of the head joint that is used to lock the movement of said plug body to that of said flute crown screw, said counterweights are secured to said mechanical plug via one or more set screws and a crown assembly having a swiveling joint nut. In another aspect, said compression ring is made of nylon. In yet another aspect, said compression ring is made of brass. In another aspect, said plug's distal end inside has a tapered or conical shape.

In one aspect, the invention is about a mechanical plug having a distal end with a diameter that is slightly smaller than the head joint body interior diameter, said distal end having an open rim groove for securing a single O-ring, so that only said single O-ring perimeter continuously contacts the flute interior surface, and a narrow diameter near end having flute crown screw securing means, said plug having an opening through said plug's center suitable for passage through said opening of said crown screw, an O-ring and one or more counterweights designed to fit around said mechanical plug near end.

Other features and advantages of the present invention will become apparent upon examining the following detailed description of an embodiment thereof, taken in conjunction with the attached drawings.

Figure 1:
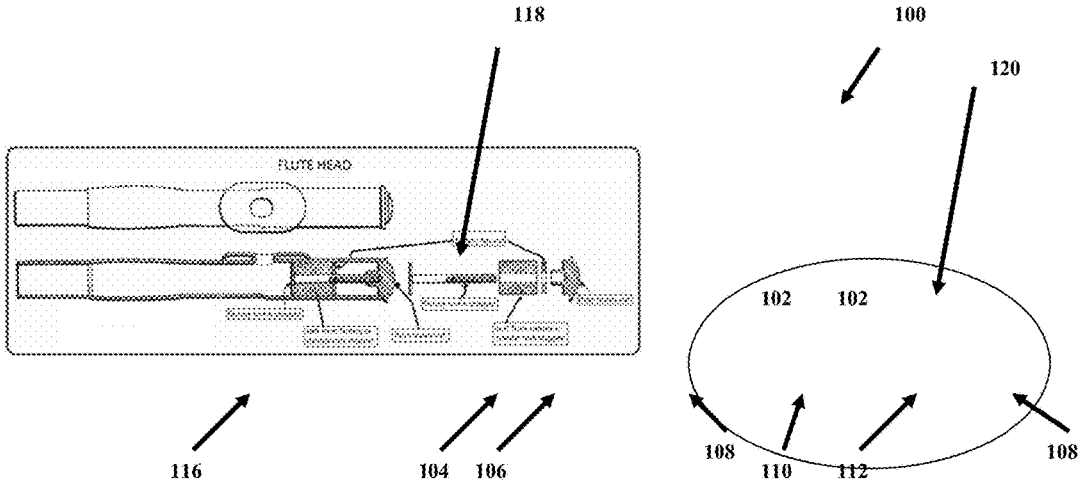
Figure 1 Prior Art
FIG. 1 shows an illustration of a traditional cork stopper, according to the prior art.

The above-described and other features will be appreciated and understood by those skilled in the art from the following detailed description, drawings, and appended claims.

DETAILED DESCRIPTION OF THE PREFERRED EMBODIMENT

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

Simplifications or omissions may be made to avoid obscuring the purpose of the section. Such simplifications or omissions are not intended to limit the scope of the present invention. All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

As used in the specification and claims, the singular forms "a", "an" and "the" include plural references unless the context clearly dictates otherwise. For example, the term "a transaction" may include a plurality of transaction unless the context clearly dictates otherwise. As used in the specification and claims, singular names or types referenced include variations within the family of said name unless the context clearly dictates otherwise.

Certain terminology is used in the following description for convenience only and is not limiting. The words "lower," "upper," "bottom," "top," "front," "back," "left," "right" and "sides" designate directions in the drawings to which reference is made, but are not limiting with respect to the orientation in which the modules or any assembly of them may be used.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Referring to FIG. 1, we see a traditional flute head 100 and its parts, according to the Prior Art. The opening, called an embouchure hole 118, is at the head of the unit, usually next to the stopper assembly 120, comprised of a factory flat nut 102, a screw stopper 104, a standard cork portion 106, a flute crown nut 108 and factory screw 110 (commonly referred to as a stopper screw and/or head joint screw). The cork 106 has an outer diameter significantly similar to the inner diameter of the flute head, so that when assembled and inserted into the flute, it effectively sets the length of the cavity 116, and hence the sound of the flute.

Figure 2:
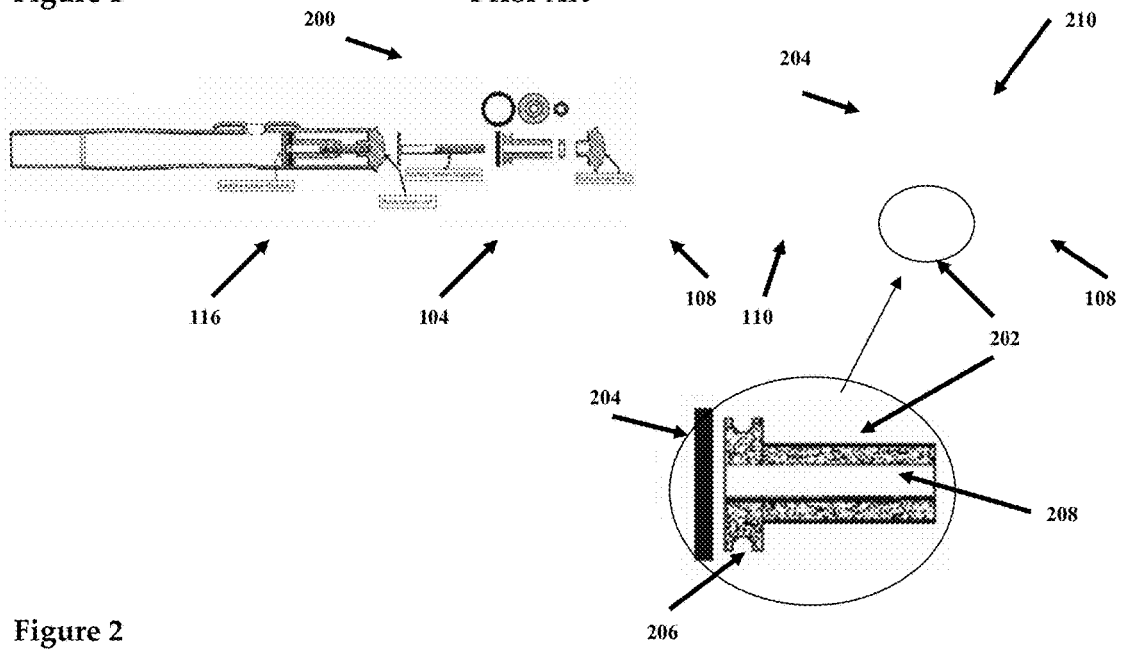
FIG. 2 shows an illustration of the proposed improved stopper installed within a flute, according to an illustrative embodiment of the invention.

Referring to FIG. 2 we see one of the parts of the new stopper assembly 200 and its interface to the flute head. The cork's cavity 116 sealing function is performed by an O-ring 204 mounted in a mechanical plug 202. The outer diameter of said O-ring is designed to fit snuggly within the flute head's inner diameter, so that the cavity 116 is sealed. The mechanical plug 202 has an opening or hole traveling through its center 208 from end to end, so that the original factory screw 110 may slide through it.

The screw stopper 104 at the cavity (or lower) end acts as a resting place for the plug 202, with the upper end (the end closer to the crown nut 108) of the plug 202 is held by a nut or compression fitting. In this fashion, when the assembly is inserted into the flute and connected to the flute crown nut 108, the complete assembly is displaced into/out of the cavity 116 (and therefore tuning it) by rotating the crown nut 108.

The compression ring choice of material has been found to induce different sound characteristics to the flute sound. When brass or another metal is used, the sound is different from that of a nylon or other plastic. In one embodiment, the plug distal end is secured by the original factory flat nut 102. In an alternate embodiment, a smaller nut 210 is used. In both cases, there is the risk that over time, either nut (102, 210) may become lose, introducing some bias or 'play' into the adjustment. In one embodiment, a pressure washer may be placed between the plug 202 and the nut.

Figure 4:
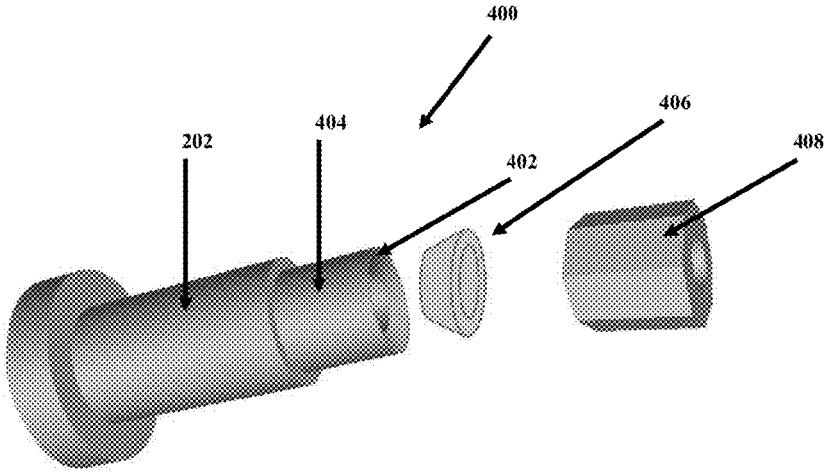
FIG. 4 shows an illustration of a stopper assembly components, according to an illustrative embodiment of the invention.
Figure 5:
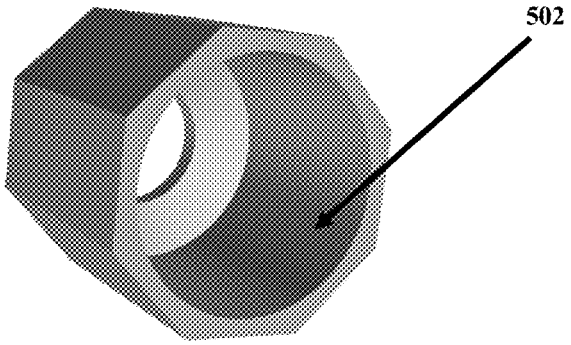
FIG. 5 shows an illustration of the stopper assembly top nut, according to an illustrative embodiment of the invention.

The stopper assembly 400, is primarily comprised of the O-ring 204, plug 202/302 and the top nut 408. In another embodiment, an optional compression fitting is used to secure the plug 202 to the factory screw 110. By placing a thread 404 around and shaping the inside of the top 402 of the plug (FIGS. 4-5), it is possible to insert a compression ring or ferrule 406, which in turn is pressed by a top nut 408 having a thread 502 compatible with that 404 of the plug 202. Tightening the top nut 408 proceeds to compress the ring against the screw 110, in effect pressing down the bottom of the plug 202 into the screw stopper 104 end of the screw 110, and securing it to the screw 110.

In an alternate embodiment, the bottom 402 is shaped as an NPT fitting (either round, conical, or double conical), accomplishing the same compression to the top nut 408. In all cases, when the screw 110 goes into the crown nut 108, rotation of the nut 108 will result in displacement of the assembly within the cavity 116 and tuning.

In one embodiment, the plug 202 has a dual rimmed O-ring groove (or U-channel) portion 206 designed to hold the O-ring 204. In this fashion, the pressing surface of the O-ring 204 seals the perimeter of the plug/cavity interface, performing the sealing of the cavity 116 function the cork 106 performed previously, and effectively setting the length of the cavity 116.

Figure 3:
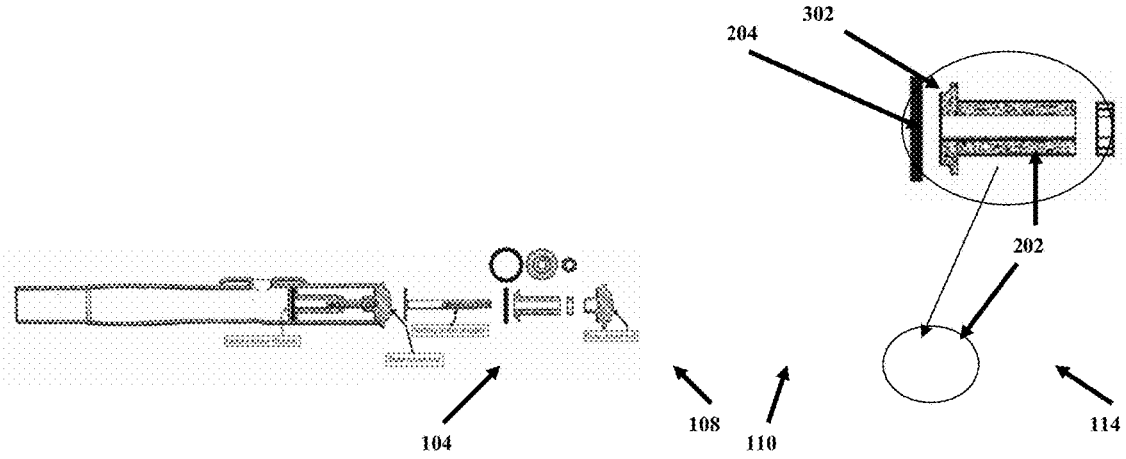
FIG. 3 shows an illustration of the proposed improved stopper installed within a flute, according to an illustrative embodiment of the invention.
Figure 6:
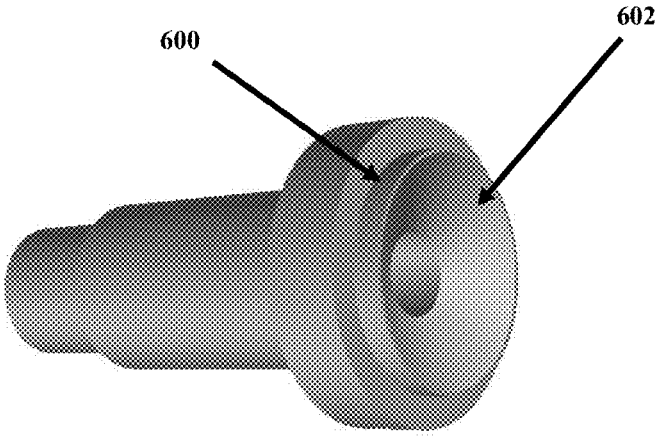
FIG. 6 shows an illustration of the bottom of the stopper assembly plug, according to an illustrative embodiment of the invention.
Figure 7:
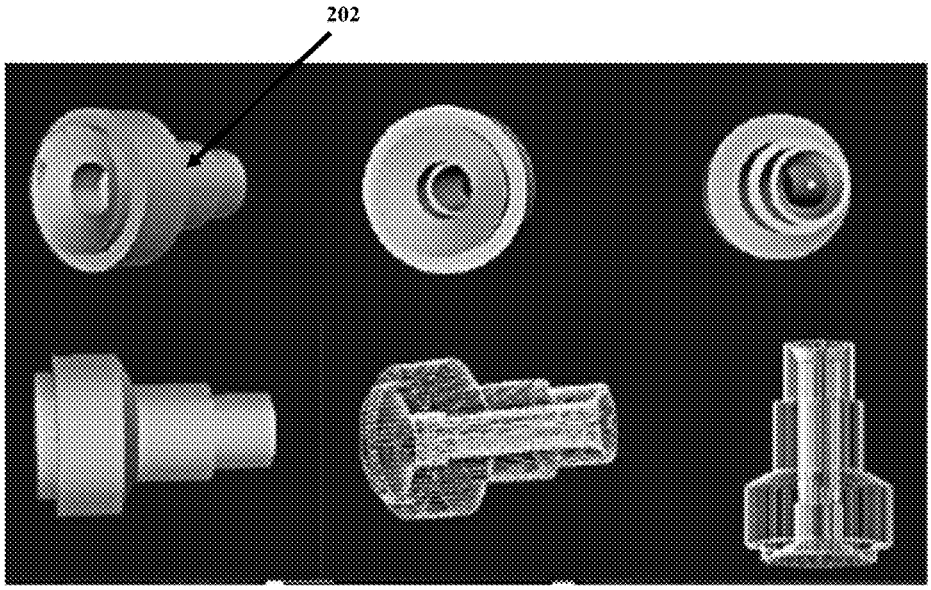
FIG. 7 shows various illustrations of the plug, according to illustrative embodiments of the invention.

In an alternate embodiment (FIGS. 3 and 6-7) the bottom of the plug 202 is an open rim groove, having a single rim 600, against one side of which the O-ring rests, leaving the other side open. This makes is easier to insert the O-ring 204. The O-ring 204 is held in place by the screw stopper 104 end of the screw 110, which is attached to the top of the plug 202. As before, this may be accomplished either by nuts (102, 210), NPT or compression fitting. In another embodiment, the groove is a triangular groove.

A singular advantage is that the diameter of the O-ring 204 may be adjusted by the tightening of the top nut 408, which presses the bottom or first end of the plug 202 into the screw stopper 104, thus squeezing the O-ring and increasing its effective diameter. The inside of the bottom 602 is tapered in order to accommodate both types of screw stoppers 104 in the market. Some are flat as shown, others are tapered or semi-conical, and would nestle inside the shape of the bottom 602.

The plug 202 may be manufactured of a combination of materials, including ferrous and non-ferrous metals (brass, copper, etc.), bone, wood and polymers, plastic or thermoplastics. These include such well known materials as nylon, ABS ("acrylonitrile butadiene styrene") or other such moldable plastics. The O-ring may also be manufactured from such polymers, silicone, natural or synthetic rubber, leather, etc. More information on proper O-ring materials and design can be found on the Parker O-Ring Handbook (ORD 5700) the contents of which are incorporated herein by reference.

Figure 8:
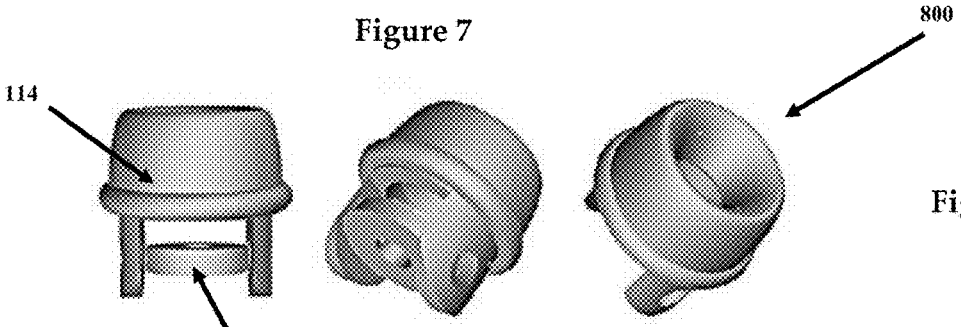
FIGS. 8-9 show illustrations of the crown assembly components, according to illustrative embodiments of the invention.
Figure 9:
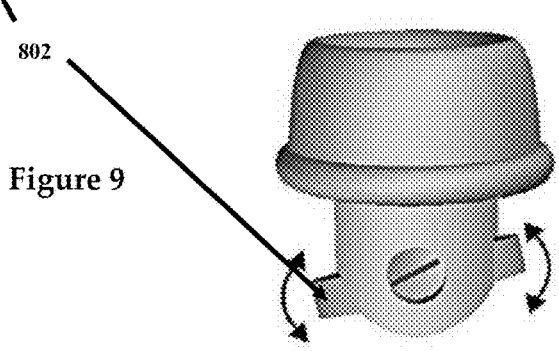

Referring to FIGS. 8-9, we see a critical optional component to the system, the flexible crown assembly 800 formed from a crown 114 which has an integral swiveling joint nut 802 whose center thread takes the place of the traditional flute crown nut 108 and links to the factory screw 110 in the center of the assembly. Thus, the flexible crown's 800 joint nut 802 attaches onto the factory screw 110, and forms the center of the resonator. The swiveling nut 802 allows for the crown 114 to remain flat against the flute head upper end while allowing for slight swiveling to correct any slight angling of the screw 110. Rotation of the crown 114 of course results in the traditional adjustment of the O-ring 204 mounted in the mechanical plug 202, adjusting the cavity of the flute or piccolo.

Figure 10:
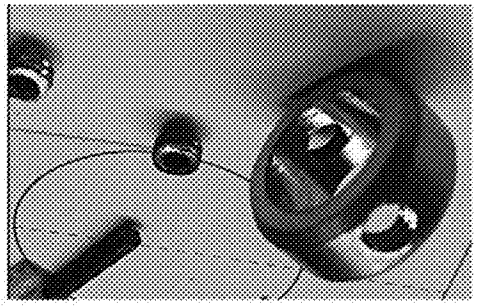
FIG. 10 shows an illustration of a counterweight and set screws, according to an illustrative embodiment of the invention.

Referring to FIG. 10, we see the final component of the resonator assembly, the addition of one or more counterweights 1002 around the plug 202. In one embodiment, these can be set at any point of the length of the upper section 1102 of the plug 202 via one or more set nuts 1004. The counterweights 1002 placement variation allows you to provide the stopper with additional mass (adjusting the resonance), as well as to adjust the overall balance of the musical instrument within the user's hands.

Figure 11:
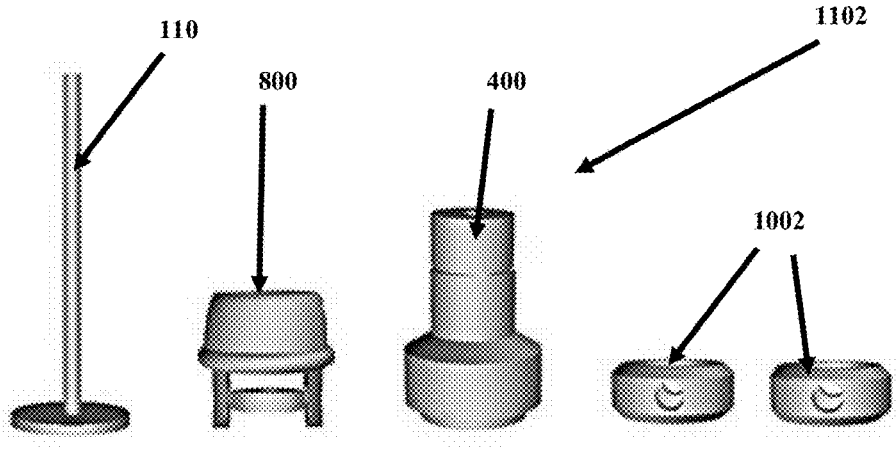
FIGS. 11-17 show illustrations of the complete resonator assembly, according to illustrative embodiments of the invention.
Figure 12:
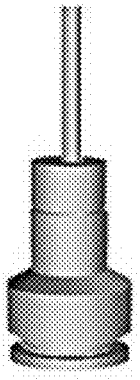
Figure 13:
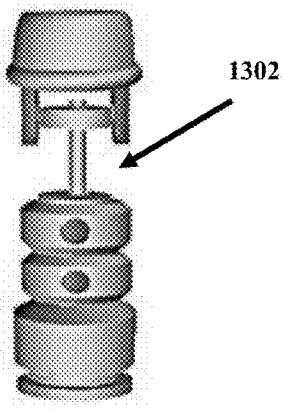
Figure 14:
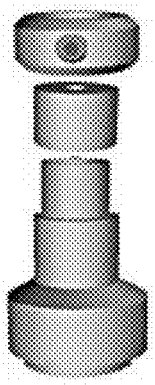
Figure 15:
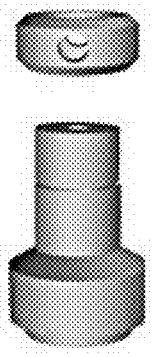
Figure 16:
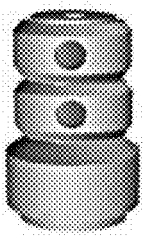
Figure 17:
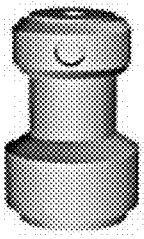
Figure 18A:
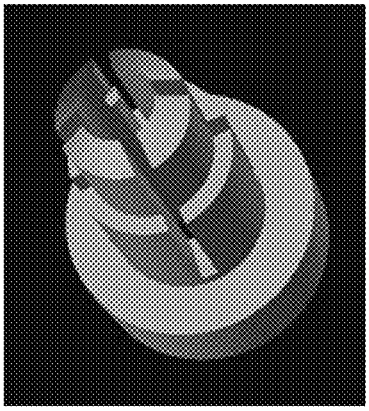
FIGS. 18A-18D shows a slug having lengthwise slits made along the upper portion, according to an illustrative embodiment of the invention.
Figure 18B:
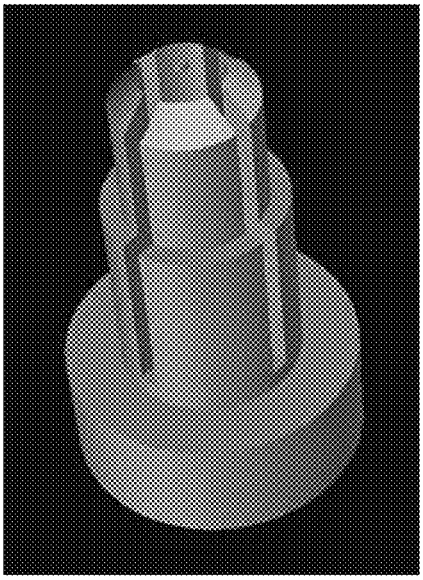
Figure 18C:
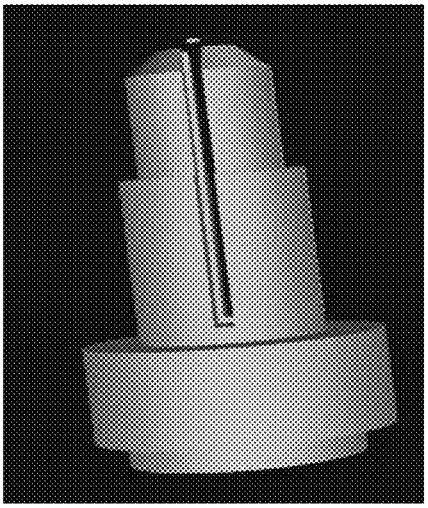
Figure 18D:
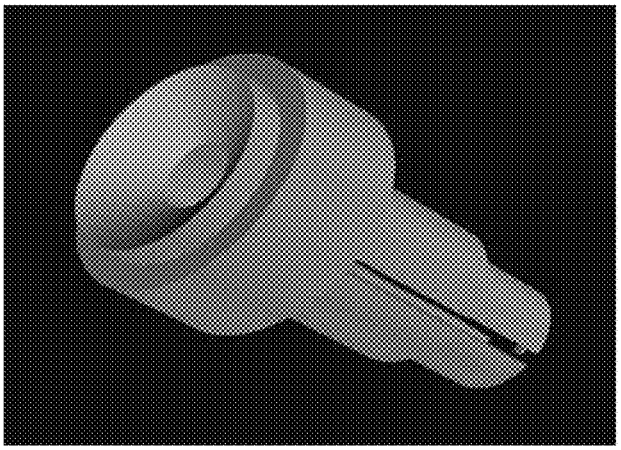
Figure 19A:
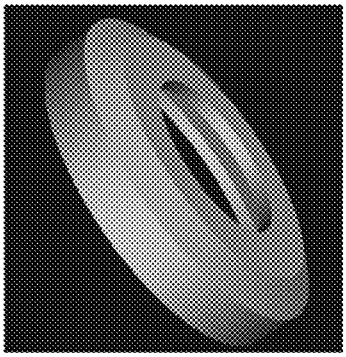
FIGS. 19A-19H shows the various components of the optional flute crown, according to an illustrative embodiment of the invention.
Figure 19B:
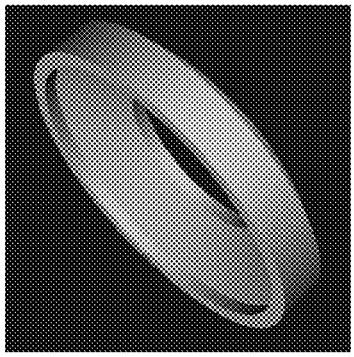
Figure 19C:
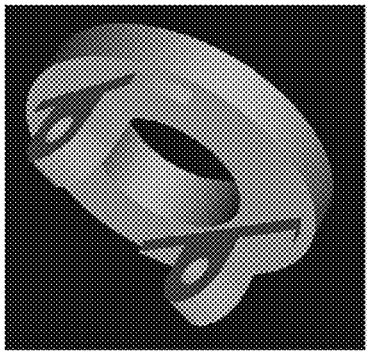
Figure 19D:
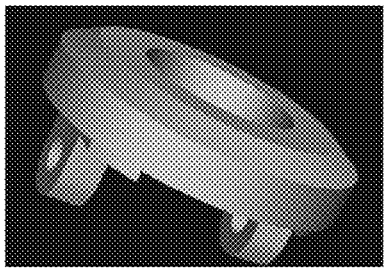
Figure 19E:
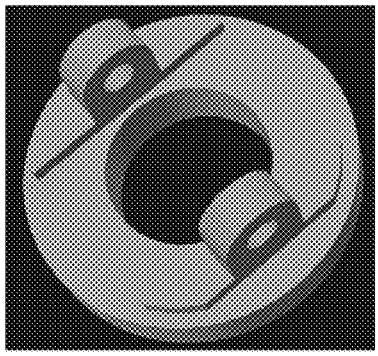
Figure 19F:
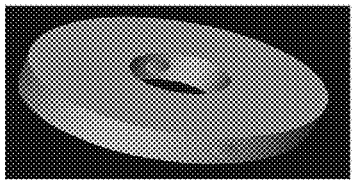
Figure 19G:
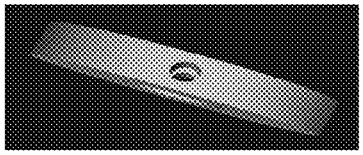
Figure 19H:
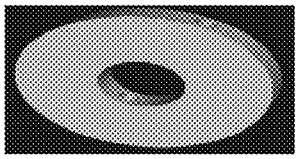

Referring to FIG. 11, we can see the components 1102 of the complete resonator, the factory screw 110, crown assembly 800, the stopper assembly 400, and one or more counterweights 1002. In one embodiment (FIG. 12), the weights 1002 and crown assembly 800 are avoided (using the flute factory supplied crown). In another embodiment (FIG. 13), two weights 1002 are used 1302.

Other examples are shown, FIGS. 14-17. FIGS. 18A-18D illustrate an embodiment where the main body of the plug 202 is separated by slots along it's length, allowing for mechanical release of the unit. Referring to FIGS. 19A-19H we see the various components of the optional flute crown in detail. In particular, one or more weights may be added to the area below the 'hat' (FIG. 19A-19B) (either magnetic weights for ease of installation and/or weights with glue) to the crown (19C-19D) provides another counterweight possibility. The crown itself may be solid or hollow, to house the aforementioned magnets. While all these weights don't affect the sound as directly as the counterweights in the resonator, they provide the advantage of balancing the flute body.

CONCLUSION

In concluding the detailed description, it should be noted that it would be obvious to those skilled in the art that many variations and modifications can be made to the preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any "preferred embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the forgoing description of embodiments.

The invention claimed is:

1. A flute resonator comprising:

a mechanical plug having a distal end with a diameter that is slightly smaller than the head joint body interior diameter, said distal end having a U-channel groove for securing a single O-ring, so that only said single O-ring perimeter continuously contacts the flute interior surface, and a narrow diameter near end having flute crown screw securing means, said plug having an opening through said plug's center suitable for passage through said opening of said crown screw;

an O-ring; and one or more counterweights designed to fit around said mechanical plug near end.

2. The flute resonator of claim 1 wherein;

said flute crown screw securing means are comprised of a nut smaller than the diameter of the head joint that is used to lock the movement of said plug body to that of said flute crown screw;

said counterweights are secured to said mechanical plug via one or more set screws; and said flute crown is comprised of a crown assembly having a swiveling joint nut designed to fit around said crown screw.

3. The flute resonator of claim 1 wherein;

said flute crown screw securing means are comprised of a flat nut smaller than the diameter of the head joint that is used to lock the movement of said plug body to that of said flute crown screw;

said counterweights are secured to said mechanical plug via one or more set screws; and said flute crown is comprised of a crown assembly having a swiveling joint nut designed to fit around said crown screw.

4. The flute resonator of claim 1 wherein;

said flute crown screw securing means are comprised of an NPT fitting nut smaller than the diameter of the head joint that is used to lock the movement of said plug body to that of said flute crown screw;

said counterweights are secured to said mechanical plug via one or more set screws; and a crown assembly having a swiveling joint nut.

5. The flute resonator of claim 1 wherein;

said plug's near end inside is tapered;

said flute crown screw securing means are comprised of a compression fitting having a compression ring smaller than the diameter of the head joint that is used to lock the movement of said plug body to that of said flute crown screw;

said counterweights are secured to said mechanical plug via one or more set screws; and a crown assembly having a swiveling joint nut.

6. The flute resonator of claim 5 wherein;

said compression ring is made of nylon.

7. The flute resonator of claim 5 wherein;

said compression ring is made of brass.

8. The flute resonator of claim 5 wherein;

said plug's distal end inside has a tapered or conical shape.

9. A flute resonator comprising:

a mechanical plug having a distal end with a diameter that is slightly smaller than the head joint body interior diameter, said distal end having an open rim groove for securing a single O-ring, so that only said single O-ring perimeter continuously contacts the flute interior surface, and a narrow diameter near end having flute crown screw securing means, said plug having an opening through said plug's center suitable for passage through said opening of said crown screw;

an O-ring; and one or more counterweights designed to fit around said mechanical plug near end.

10. The flute resonator of claim 9 wherein;

said flute crown screw securing means are comprised of a nut smaller than the diameter of the head joint that is used to lock the movement of said plug body to that of said flute crown screw;

said counterweights are secured to said mechanical plug via one or more set screws; and a crown assembly having a swiveling joint nut.

11. The flute resonator of claim 9 wherein;

said flute crown screw securing means are comprised of a flat nut smaller than the diameter of the head joint that is used to lock the movement of said plug body to that of said flute crown screw;

said counterweights are secured to said mechanical plug via one or more set screws; and a crown assembly having a swiveling joint nut.

12. The flute resonator of claim 9 wherein;

said flute crown screw securing means are comprised of an NPT fitting nut smaller than the diameter of the head joint that is used to lock the movement of said plug body to that of said flute crown screw;

said counterweights are secured to said mechanical plug via one or more set screws; and a crown assembly having a swiveling joint nut.

13. The flute resonator of claim 9 wherein;

said plug's near end inside is tapered;

said flute crown screw securing means are comprised of a compression fitting having a compression ring smaller than the diameter of the head joint that is used to lock the movement of said plug body to that of said flute crown screw;

said counterweights are secured to said mechanical plug via one or more set screws; and a crown assembly having a swiveling joint nut.

14. The flute resonator of claim 13 wherein;

said compression ring is made of nylon.

15. The flute resonator of claim 13 wherein;

said compression ring is made of brass.

16. The flute resonator of claim 13 wherein;

said plug's distal end inside has a tapered or conical shape.

* * * * *